US012426675B2

(12) United States Patent
Hartmann et al.

(10) Patent No.: US 12,426,675 B2
(45) Date of Patent: Sep. 30, 2025

(54) SOLE STRUCTURE OF A SHOE

(71) Applicants: PUMA SE, Herzogenaurach (DE); MASSACHUSETTS INSTITUTE OF TECHNOLOGY, Cambridge, MA (US)

(72) Inventors: Matthias Hartmann, Forchheim (DE); Reinhold Sussmann, Scheinfeld (DE); Federico Casalegno, San Francisco, CA (US); Hunmin Koh, Somerville, MA (US); Yihyun Lim, Somerville, MA (US); Yasaman Tahouni, Cambridge, MA (US); Will Walker, Oakland, CA (US)

(73) Assignees: PUMA SE, Herzogenaurach (DE); MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 0 days.

(21) Appl. No.: 18/370,290

(22) Filed: Sep. 19, 2023

(65) Prior Publication Data

US 2024/0008596 A1 Jan. 11, 2024

Related U.S. Application Data

(63) Continuation of application No. 18/228,780, filed on Aug. 1, 2023, which is a continuation of application (Continued)

(51) Int. Cl.
*A43B 13/18* (2006.01)
*A43B 13/12* (2006.01)

(52) U.S. Cl.
CPC ..... *A43B 13/181* (2013.01); *A43B 13/125* (2013.01); *A43B 13/187* (2013.01)

(58) Field of Classification Search
CPC ... A43B 13/181; A43B 13/125; A43B 13/187; A43B 13/206; A43B 13/14; A43B 1/0009; A43B 3/0052; A43B 3/0057
See application file for complete search history.

(56) References Cited

U.S. PATENT DOCUMENTS 2,983,056 A * 5/1961 Murawski ..... A43B 13/206 36/32 R
4,235,026 A * 11/1980 Plagenhoef ..... A43B 13/181 36/28

(Continued)

*Primary Examiner* — Haley A Smith
(74) *Attorney, Agent, or Firm* — Quarles & Brady LLP

(57) ABSTRACT

An article of footwear includes an upper and a sole structure. The sole structure has a longitudinal extension in a longitudinal direction and a vertical extension in a vertical direction. The sole structure defines a plurality of recesses arranged at least in a rearfoot region thereof and extend at least partially into the sole structure in a transverse direction and along a straight line that extends in the longitudinal direction. Without external forces on the sole structure, each recess of the plurality of recesses is larger in a first direction than in a second direction. The sole structure is configured to provide predetermined dampening and spring deflection characteristics such that, when an external force is applied to the sole structure, the plurality of recesses collapse in a predetermined manner and, when the external force is removed, the plurality of recesses expand back to their original shape.

19 Claims, 3 Drawing Sheets

Related U.S. Application Data

No. 17/053,510, filed as application No. PCT/EP2018/061934 on May 8, 2018, now Pat. No. 11,744,322.

(56) References Cited

U.S. PATENT DOCUMENTS

| | | | | | |
|---|---|---|---|---|---|
| 4,364,189 | A * | 12/1982 | Bates | A43B 13/12 | 36/31 |
| 4,506,461 | A * | 3/1985 | Inohara | A43B 13/20 | 36/35 B |
| 6,920,707 | B1 * | 7/2005 | Greene | A43B 13/16 | 36/97 |
| 2008/0127513 | A1 * | 6/2008 | Schinlder | A43B 13/206 | 36/25 R |
| 2014/0033574 | A1 * | 2/2014 | Wan | A43B 1/0072 | 36/103 |
| 2017/0360150 | A1 * | 12/2017 | Gould | A43B 7/36 | |

* cited by examiner

SOLE STRUCTURE OF A SHOE

CROSS REFERENCE TO RELATED APPLICATIONS

The present application is a continuation of U.S. application Ser. No. 18/228,780, filed on Aug. 1, 2023, which is a continuation of U.S. application Ser. No. 17/053,510, filed on Nov. 6, 2020, which is a U.S. National Stage application, filed pursuant to 35 U.S.C. § 371, of International Application No. PCT/EP2018/061934, filed on May 8, 2018, and which are each incorporated herein by reference in their entirety.

REFERENCE REGARDING FEDERALLY SPONSORED RESEARCH OR DEVELOPMENT

Not applicable

SEQUENCE LISTING

Not applicable

BACKGROUND

The invention relates to a sole of a shoe, i.e., an article of footwear, particularly of an athletic shoe. The sole has an extension in a longitudinal direction and an extension in a vertical direction perpendicular thereto. A number of recesses is introduced into the sole that extend in a transverse direction perpendicular to the longitudinal direction and perpendicular to the vertical direction and permeate the sole at least in part.

In the case of sports shoes, an attempt is made to give the sole a certain and desired spring behaviour by means of the geometric design of the sole. This means that the sole exhibits a desired deformation behaviour in the vertical direction when subjected to the weight of the wearer of the shoe, in particular a certain characteristic curve between the force applied and the strain in the vertical direction.

A sole of the type mentioned above is known from U.S. Pat. No. 2,983,056. The body of the sole is provided here in transverse direction with a plurality of recesses, which are formed circularly, laterally on the sole, thus seen in transverse direction. The recesses have different diameters, whereby one with a smaller diameter is located between two recesses with a larger diameter. Such recesses can be used to influence the spring or damping behaviour of the sole.

The invention is based on the object to further develop a shoe sole of the type mentioned above in such a way that it becomes possible to influence the spring and damping behaviour of the sole in a desired, predetermined improved manner.

The solution of this object by the invention is characterized in that there is a first group of recesses, which (without external forces on the sole) are larger in the vertical direction than in the longitudinal direction, and a second group of recesses, which (without external forces on the sole) are smaller in the vertical direction than in the longitudinal direction. At least in sections, at least one row of recesses is arranged adjacent to each other in the longitudinal direction with a recess of the second group arranged between two recesses of the first group.

An upper row of recesses and a lower row of recesses can thereby be arranged above one another in the vertical direction, at least in sections. The upper and lower rows of recesses are in this case preferably arranged relative to each other in such a way that a recess of the first group lies vertically above a recess of the second group.

The recesses penetrate preferably at least partially the sole completely in the transverse direction.

The recesses extend thereby preferably along a straight line, and they are thus designed straight and linear respectively.

Without external forces on the sole, preferably the largest dimension of a recess in a first direction is thereby at least 150%, preferably at least 180%, of the largest dimension of the recess in a second direction perpendicular to the first direction. Thereby, it is specifically preferred that the recesses, seen in the transverse direction, have a peripheral contour which has the shape of an eight. The recess has in this case in a central region preferably a restriction with a minimum extension which is at most 90%, preferably at most 80%, of the largest dimension in the second direction.

The largest dimension is thereby preferably between 8 millimeters (mm) and 18 mm, specifically preferred between 10 mm and 15 mm.

The wall thickness of the material of the sole remaining between the recesses is preferably substantially constant at least in sections. Insofar, it is preferred that the wall thickness at least in sections is in a range between 80% and 120% of an average value of the wall thickness (the average value of the wall thickness is the arithmetic mean, which is determined for the respective wall thicknesses between adjacent recesses over a given defined area of the lateral surface of the sole).

The sole consists preferably of polyurethane material, thermoplastic polyurethane (TPU) or thermoplastic elastomer (TPE) or comprises at least this material. The material of the sole is thereby preferably foamed.

The material of the sole has preferably a density between 0.20 and 0.50 g/cm$^3$. The sole has preferably a hardness between 30 and 50 Asker C.

The sole can be designed as a midsole. Thereby, it is possible that an outer sole is arranged below the midsole.

The recesses are preferably arranged in the longitudinal direction over at least 33% of the total longitudinal extension of the sole. The recesses are preferably arranged at least in a midfoot region and a rearfoot region of the sole.

The proposed design of the sole makes it possible to influence the control of the spring and cushioning properties or the hardness of the sole in a simple way. By the design of the recesses it is possible to realize a desired spring deflection when the sole is loaded with the weight of the wearer of the shoe equipped with the sole.

The present invention is based on the use of so-called "Mechanical Meta Material", in which it is intended that various rows of openings (known in the art are mainly round or oval shaped recesses in cross-section) of different sizes are or are to be introduced into the sole in order to achieve a certain spring or cushioning behaviour of the sole. This enables "Engineered Damping", in which the spring or damping properties obey a desired characteristic curve.

When a deformation force—caused by the weight of the wearer of the shoe—is applied, the resulting cells collapse in a special way so that special spring or damping characteristics can be realized.

In this respect, a "programmable folding or collapsing" of the sole structure is achieved, so to speak, since the structure itself forms a coherent system and the individual material sections are interdependent.

The advantages of the proposed structure can lead to a "negative stiffness", i.e., if the sole is slightly compressed in a vertical direction, the sole collapses in a defined way. It is also possible to structure the sole in the way described above in such a way that it has a sufficient degree of elasticity on the one hand and absorbs deformation energy as a result of a deformation force on the other.

SUMMARY

A shoe, i.e., an article of footwear, as described herein, may have various configurations. For example, an article of footwear may have an upper and a sole structure connected to the upper.

In some aspects, the present disclosure provides an article of footwear including an upper and a sole structure that has a longitudinal extension in a longitudinal direction and a vertical extension in a vertical direction that is perpendicular to the longitudinal direction. The sole structure defines a plurality of recesses that extend at least partially into the sole structure in a transverse direction that is substantially perpendicular to the longitudinal direction. The plurality of recesses are arranged at least in a rearfoot region of the sole structure and extend along a straight line that extends in the longitudinal direction. Without external forces on the sole structure, each recess of the plurality of recesses is larger in a first direction than in a second direction. The sole structure is configured to provide predetermined dampening and spring deflection characteristics such that, when an external force is applied to the sole structure, the plurality of recesses collapse, at least in sections, in a predetermined manner and, when the external force is removed, the plurality of recesses expand back to their original shape.

In some embodiments, the first direction is noncoaxial with respect to the longitudinal direction. In some embodiments, the second direction is noncoaxial with respect to the vertical direction. In some embodiments, the first direction is perpendicular with respect to the second direction. In some embodiments, the plurality of recesses is arranged at least in a midfoot region and the rearfoot region of the sole structure. In some embodiments, each recess of the plurality of recesses has a first dimension in the first direction and a second dimension in the second direction, the first dimension being at least 150% larger than the second dimension. In some embodiments, the sole structure comprises a thermoplastic elastomer (TPE). In some embodiments, the plurality of recesses is arranged in the longitudinal direction over at least 33% of a total distance taken along the longitudinal extension of the sole structure. In some embodiments, the plurality of recesses is defined on a midsole of the sole structure, and the midsole is connected to the upper and an outsole of the sole structure is arranged below the midsole. In some embodiments, without external forces on the sole structure, each recess of the plurality of recesses has a peripheral contour forming a shape that is non-circular when viewed in the transverse direction.

In other aspects, the present disclosure provides an article of footwear including an upper and a sole structure having a longitudinal extension in a longitudinal direction and a vertical extension in a vertical direction that is perpendicular to the longitudinal direction. The sole structure includes a midsole connected to the upper and an outsole connected to the midsole. The midsole defines a plurality of recesses that extend at least partly into the midsole in a transverse direction that is substantially perpendicular to the longitudinal direction. The plurality of recesses is arranged at least in a rearfoot region and a midfoot region of the midsole and extend along a straight line that extends in the longitudinal direction. Without external forces on the sole structure, each recess of the plurality of recesses has a peripheral contour when viewed in the transverse direction and has a first largest dimension in a first direction and a second largest dimension in a second direction that is substantially perpendicular to the first direction. The first largest dimension is at least 150% larger than the second largest dimension. The sole structure is configured such that, when an external force is applied to the sole structure, the plurality of recesses collapse, at least in sections, in a predetermined manner to provide predetermined dampening and spring characteristics.

In some embodiments, the first direction is non-parallel with respect to the longitudinal direction. In some embodiments, a shape of the peripheral contour of each recess of the plurality of recesses is non-circular. In some embodiments, the shape of each recess of the plurality of recesses has at least three inflection points. In some embodiments, the midsole comprises a thermoplastic elastomer (TPE). In some embodiments, the first largest dimension is at least 180% larger than the second largest dimension.

In some aspects, the present disclosure provides a sole structure of an article of footwear that includes a midsole and an outsole connected to the midsole. The sole structure has a longitudinal extension in a longitudinal direction and a vertical extension in a vertical direction that is perpendicular to the longitudinal direction. The midsole defines a plurality of recesses that extend at least partly into the midsole in a transverse direction that is substantially perpendicular to the longitudinal direction. The plurality of recesses are disposed along a straight line that extends in the longitudinal direction and at least some of the recesses of the plurality of recesses are arranged within a rearfoot region of the sole structure. Without external forces on the sole structure, each recess of the plurality of recesses has a peripheral contour forming a shape that is non-circular when viewed in the transverse direction and has a first largest dimension in a first direction and a second largest dimension in a second direction that is substantially perpendicular to the first direction. The first largest dimension is at least 150% larger than the second largest dimension. At least the midsole has elastomeric properties and is configured such that, when an external force is applied to the sole structure, the plurality of recesses collapse, at least in sections, in a predetermined manner to provide predetermined dampening and spring characteristics.

In some embodiments, the second direction is noncoaxial with respect to the vertical direction. In some embodiments, the shape of each recess of the plurality of recesses has at least three inflection points. In some embodiments, the plurality of recesses includes at least four recesses.

BRIEF DESCRIPTION OF THE DRAWINGS

In the drawings an embodiment of the invention is shown.

DETAILED DESCRIPTION OF THE DRAWINGS

Figure 1:
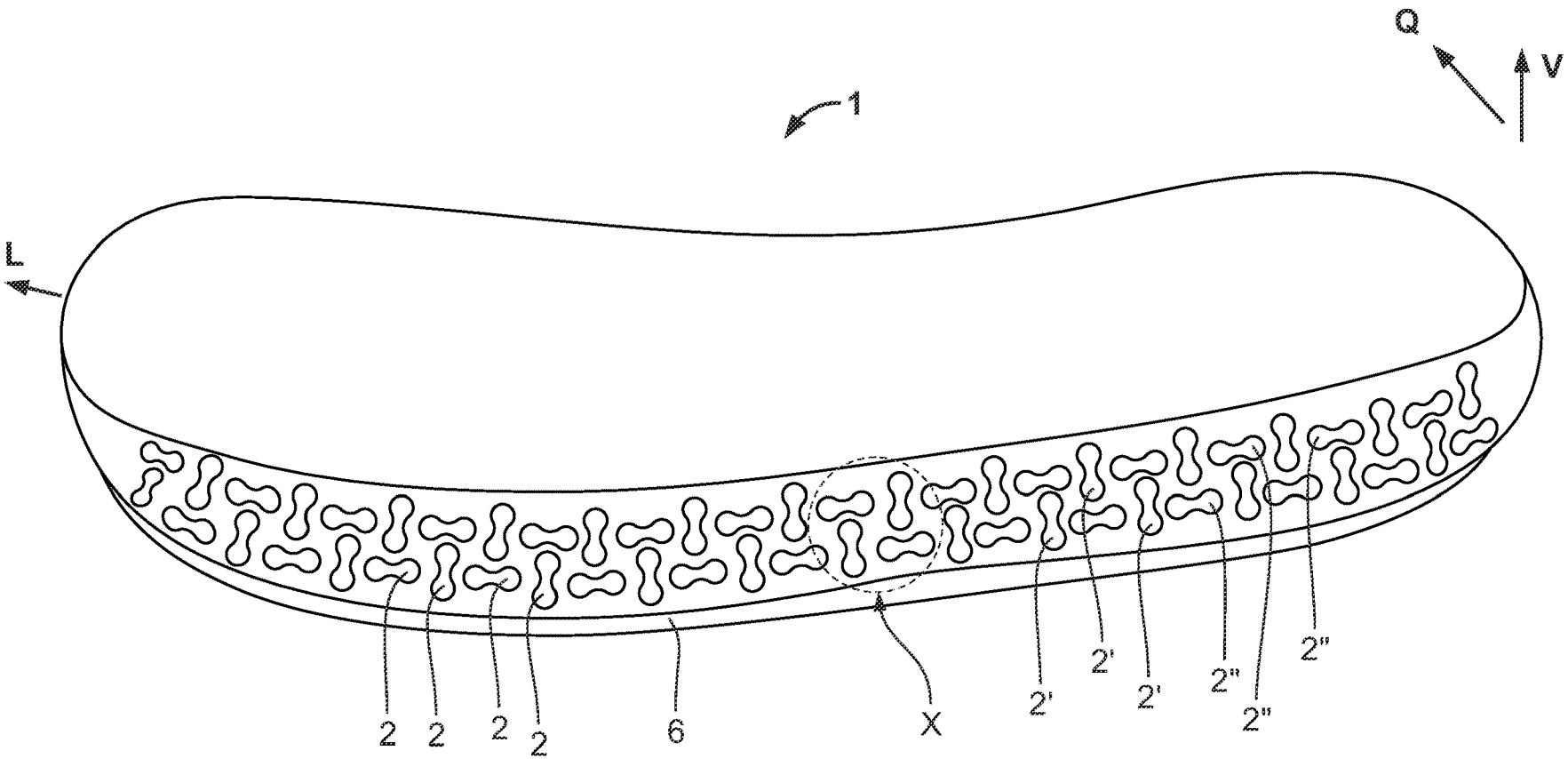
FIG. 1 is a side perspective view of a sole of a shoe.

FIG. 1 shows a sole 1, which extends in a longitudinal direction (L) (corresponding to the longitudinal axis of the shoe with the sole) and in a vertical direction (V) (the vertical direction (V) indicates the direction when the shoe or the sole is standing on the ground when used as intended). Furthermore, sole 1 extends in a transverse direction (Q), which is perpendicular to both the longitudinal direction (L) and the vertical direction (V).

Sole 1 is here designed as a midsole, to the upper side of which the shoe upper (not shown) is attached in the known manner. An outer sole 6 is attached to the bottom of the sole.

Recesses 2 are incorporated into the sole 1. Preferably, these recesses extend in transverse direction (Q) over an entire width of the sole 1. Details of the design and arrangement of recesses 2 are shown in FIGS. 2 and 3, with FIG. 2 showing the detailed area labeled "X" in FIG. 1 and FIG. 3 showing the geometrical design of a preferred design of a single recess 2.

Figure 2:
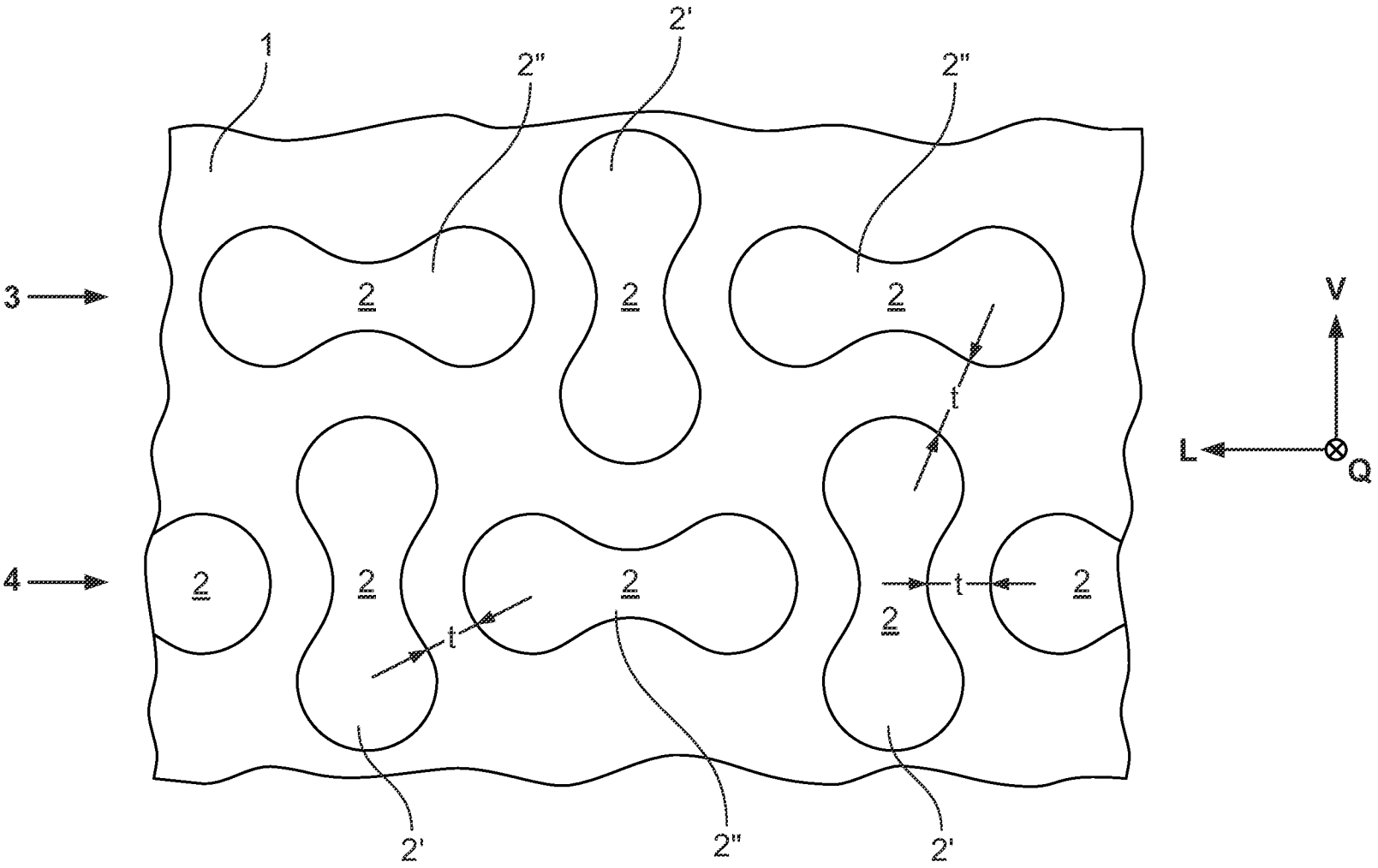
FIG. 2 is a detail view of the area labeled "X" of FIG. 1, seen in a transverse direction of the sole.

As can be seen in FIG. 2 in combination with FIG. 1, two rows 3, 4 of recesses 2 are incorporated into the sole 1. Thereby, two groups of recesses 2 are employed. A first group of recesses 2' is designed in such a way that—without external forces on the sole 1—the recesses 2' are larger in vertical direction (V) than in longitudinal direction (L). Then there is a second group of recesses 2", which—again without external forces on the sole 1—are smaller in vertical direction (V) than in longitudinal direction (L). As shown in FIG. 2, in each row 3, 4 along longitudinal direction (L) the recesses 2', 2" are arranged next to each other in such a way that a recess of the second group 2" is arranged between two recesses of the first group 2'.

Figure 3:
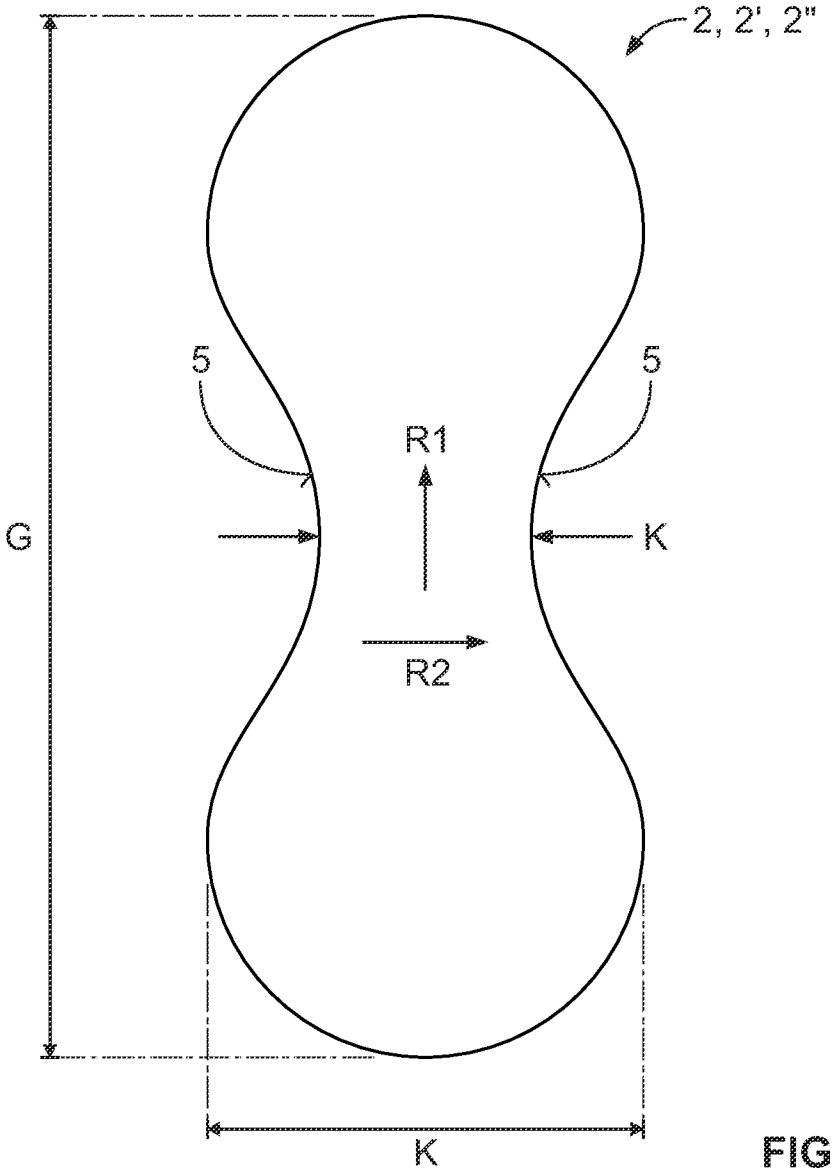
FIG. 3 is a detail view of a recess of the sole of FIG. 1.

With particular reference to FIG. 3, the individual recesses of the first and second groups of recesses 2', 2" are each designed in such a way that they have the shape of an "eight" when viewed in transverse direction (Q).

Accordingly, each recess 2', 2" has in a first direction (R1) a largest dimension (G) (which is preferably between 10 mm and 15 mm) and has in a second direction (R2), which is perpendicular to the first direction (R1), a largest dimension (K). A dimension (G) is preferably at least 150% (particularly preferably even at least 180%) of the dimension (K).

In the central area along the extension in the first direction (R1), the recesses 2', 2" have a restriction 5 (which results in the shape of an "eight"), so that the recesses 2', 2" have a minimal extension (k) here. This minimum extension (k) is preferably at most 90%, especially preferably at most 80%, of the dimension (K).

A remaining wall thickness (t), which results between adjacent recesses 2', 2", is denoted in FIG. 2 at various points. If one determines an (arithmetic) mean value between the respective wall thicknesses (t) over a selected area (such as the area shown in FIG. 2), it is preferably intended that the wall thickness (t) remains essentially constant. Specifically, this can be quantified to the effect that the wall thickness (t) at any point of the selected area is not less than 80% and not more than 120% of the mean wall thickness (t).

Through the proposed design, it can be achieved that the sole of the shoe has a special spring or cushioning behaviour, whereby, in particular when subjected to the weight of the wearer of the shoe, a predetermined collapse of the sole occurs as a result of the recesses, which provides a pleasant feeling of wear.

List of reference numerals: sole 1; recess 2; recess of the first group 2'; recess of the second group 2"; row of recesses 3; row of recesses 4; restriction 5; outer sole 6; longitudinal direction (L); vertical direction (V); transverse direction (Q); first direction (R1); second direction (R2); largest dimension of the recess in the first direction (G); largest dimension of the recess in the second direction (K); smallest extension (k); and wall thickness (t).

We claim:

1. An article of footwear, comprising:

an upper; and a sole structure having a longitudinal extension in a longitudinal direction and a vertical extension in a vertical direction that is perpendicular to the longitudinal direction, the sole structure defining a plurality of recesses that extend at least partially into the sole structure in a transverse direction that is substantially perpendicular to the longitudinal direction, wherein the plurality of recesses are arranged at least in a rearfoot region of the sole structure and are disposed along a straight line that extends in the longitudinal direction, wherein, without external forces on the sole structure, each recess of the plurality of recesses is larger in a first direction than in a second direction that is substantially perpendicular to the first direction, wherein the sole structure is configured to provide predetermined dampening and spring deflection characteristics such that, when an external force is applied to the sole structure, the plurality of recesses collapse, at least in sections, in a predetermined manner and, when the external force is removed, the plurality of recesses expand back to their original shape, wherein a first recess of the plurality of recesses includes a largest dimension measured in the first direction that is at least 150% larger than a largest dimension measured in the second direction, wherein the first recess is continuously curved along an entire edge, wherein the first recess includes a first end and a second end opposite the first end in the first direction, and wherein the largest dimension measured in the second direction is offset from a midpoint between the first end and the second end.

2. The article of footwear of claim 1, wherein the first direction is oblique with respect to the longitudinal direction.

3. The article of footwear of claim 2, wherein the second direction is oblique with respect to the vertical direction.

4. The article of footwear of claim 1, wherein the plurality of recesses is arranged at least in a midfoot region and the rearfoot region of the sole structure.

5. The article of footwear of claim 1, wherein each recess of the plurality of recesses has a first dimension in the first direction and a second dimension in the second direction, the first dimension being at least 150% larger than the second dimension.

6. The article of footwear of claim 1, wherein the sole structure comprises a thermoplastic elastomer (TPE).

7. The article of footwear of claim 1, wherein the plurality of recesses is arranged in the longitudinal direction over at least 33% of a total distance taken along the longitudinal extension of the sole structure.

8. The article of footwear of claim 1, wherein the plurality of recesses is defined on a midsole of the sole structure, and wherein the midsole is connected to the upper and an outsole of the sole structure is arranged below the midsole.

9. The article of footwear of claim 1, wherein, without external forces on the sole structure, each recess of the plurality of recesses has a peripheral contour forming a shape that is non-circular when viewed in the transverse direction.

10. An article of footwear, comprising:

an upper; and a sole structure having a longitudinal extension in a longitudinal direction and a vertical extension in a vertical direction that is perpendicular to the longitudinal direction, the sole structure comprising:

a midsole connected to the upper, the midsole defining a plurality of recesses that extend at least partly into the midsole in a transverse direction that is substantially perpendicular to the longitudinal direction; and an outsole connected to the midsole, wherein the plurality of recesses is arranged at least in a rearfoot region and a midfoot region of the midsole and are disposed along a straight line that extends in the longitudinal direction, wherein, without external forces on the sole structure, each recess of the plurality of recesses has a peripheral contour when viewed in the transverse direction and has a largest dimension in a first direction and a largest dimension in a second direction that is substantially perpendicular to the first direction, the largest dimension in the first direction being at least 150% larger than the largest dimension in the second direction, wherein the entire peripheral contour is continuously curved, wherein the sole structure is configured such that, when an external force is applied to the sole structure, the plurality of recesses collapse, at least in sections, in a predetermined manner to provide predetermined dampening and spring characteristics, wherein each recess includes a first end and a second end opposite the first end in the first direction, and wherein the largest dimension in the second direction is offset from a midpoint between the first end and the second end.

11. The article of footwear of claim 10, wherein the first direction is non-parallel with respect to the longitudinal direction.

12. The article of footwear of claim 10, wherein a shape of the peripheral contour of each recess of the plurality of recesses is non-circular.

13. The article of footwear of claim 12, wherein the shape of each recess of the plurality of recesses has at least three inflection points.

14. The article of footwear of claim 13, wherein the midsole comprises a thermoplastic elastomer (TPE).

15. The article of footwear of claim 10, wherein the largest dimension in the first direction is at least 180% larger than the largest dimension in the second direction.

16. A sole structure of an article of footwear, the sole structure comprising:

a midsole; and an outsole connected to the midsole, wherein the sole structure has a longitudinal extension in a longitudinal direction and a vertical extension in a vertical direction that is perpendicular to the longitudinal direction, wherein the midsole defines a plurality of recesses that extend at least partly into the midsole in a transverse direction that is substantially perpendicular to the longitudinal direction, wherein the plurality of recesses are disposed along a straight line that extends in the longitudinal direction and at least some of the recesses of the plurality of recesses are arranged within a rearfoot region of the sole structure, wherein, without external forces on the sole structure, each recess of the plurality of recesses has a peripheral contour forming a shape that is non-circular and continuously curved when viewed in the transverse direction and has a largest dimension in a first direction and a largest dimension in a second direction that is substantially perpendicular to the first direction, the largest dimension in the first direction being at least 150% larger than the largest dimension in the second direction, wherein at least the midsole has elastomeric properties and is configured such that, when an external force is applied to the sole structure, the plurality of recesses collapse, at least in sections, in a predetermined manner to provide predetermined dampening and spring characteristics, wherein each recess includes a first end and a second end opposite the first end in the first direction, and wherein the largest dimension in the second direction is offset from a midpoint between the first end and the second end.

17. The sole structure of claim 16, wherein the second direction is oblique with respect to the vertical direction.

18. The sole structure of claim 17, wherein the shape of each recess of the plurality of recesses has at least three inflection points.

19. The sole structure of claim 18, wherein the plurality of recesses includes at least four recesses.

* * * * *